United States Patent [19]

Braun et al.

[11] Patent Number: 4,714,822

[45] Date of Patent: Dec. 22, 1987

[54] COOKER WITH MEANS FOR AUTOMATICALLY CONTROLLING THE HEATING OF A PAN WITH FOOD MATERIAL

[75] Inventors: Walter Braun, Alsdorf; Reinhard Kersten; Egbert Kuhl, both of Aachen, all of Fed. Rep. of Germany

[73] Assignee: U.S. Philips Corporation, New York, N.Y.

[21] Appl. No.: 846,672

[22] Filed: Mar. 31, 1986

[30] Foreign Application Priority Data

Apr. 6, 1985 [DE] Fed. Rep. of Germany ..... 3512545
Aug. 26, 1985 [DE] Fed. Rep. of Germany ..... 3530403

[51] Int. Cl.[4] ..... H05B 3/68

[52] U.S. Cl. ..... 219/449; 219/450; 219/452; 219/519; 219/489

[58] Field of Search ..... 219/449, 450, 448, 443, 219/452, 453, 451, 494, 445, 446, 447, 459, 489, 492, 516, 518, 464; 126/39 G

[56] References Cited

U.S. PATENT DOCUMENTS

| | | | |
|---|---|---|---|
| 4,465,228 | 8/1984 | Mori | 236/20 A |
| 4,492,336 | 1/1985 | Takata | 219/450 |
| 4,493,980 | 1/1985 | Payne | 219/453 |
| 4,604,518 | 8/1986 | Payne | 219/492 |

FOREIGN PATENT DOCUMENTS

| | | | |
|---|---|---|---|
| 0074108 | 3/1983 | European Pat. Off. . | |
| 58-106330 | 6/1983 | Japan | 126/39 G |
| 58-200931 | 11/1983 | Japan | 126/39 G |
| 59-12233 | 1/1984 | Japan | 126/39 G |
| 59-63425 | 4/1984 | Japan | 126/39 G |
| 59-56632 | 4/1984 | Japan | 219/450 |

OTHER PUBLICATIONS

HEA-Bilderdienst Brochure, Aug. 1983.

*Primary Examiner*—E. A. Goldberg
*Assistant Examiner*—Teresa J. Walberg
*Attorney, Agent, or Firm*—Thomas A. Briody; Jack Oisher; William J. Streeter

[57] ABSTRACT

Cooker automatically controlling the heating process when bringing a food material to the boil on an electric hotplate and preventing it from boiling over at the end of the heating process. At the beginning of the heating process the power supplied to an electric hotplate can be set to a constant value which can be selected. A microprocessor continuously determines the rise in the temperature of the base of the pan as a function of time. At a pan-base temperature above about 70° C. the actual value of the rise in temperature is compared with a present desired value and when deviations occur the heating power is switched over so as to approximate the actual value of the rise in temperature to the desired value. At a pan-base temperature above about 90° C. a bending point in the temperature rise of the pan base is reached after which the heating power is switched off.

8 Claims, 6 Drawing Figures

COOKER WITH MEANS FOR AUTOMATICALLY CONTROLLING THE HEATING OF A PAN WITH FOOD MATERIAL

The invention relates to a cooker and method for automatically controlling the heating of a pan with food material in order to avoid boiling over at the end of the heating process. During the heating process the rise in the temperature of the base of the pan is continuously determined as a function of time by means of a temperature sensor.

Two methods are known by means of which electrical heating to a boil can to some extent be preprogrammed. One method is time control, the other is temperature-dependent control (cf. HEA-Bilderdienst, August 1983, Hauptberatungsstelle für Elektrizitätsanwendung eV, Frankfurt a.M., Serie Elektroherd). In the time-control method the user is able to fix the energy required for the boiling-up process, thereby also taking into account large or small volumes to be boiled. It provides, however, no self-acting regulation, and therefore does not prevent boiling over or premature switching-off if the presetting is wrong. The temperature-dependent control is a better approach to the problem. A distinction is made between an adjustable temperature (2-point or 3-point thermostat, E.G.O. System) and a fixed preset temperature point (125° C. base temperature, Siemens bimetal controller). In this form of control a temperature sensor that presses against a spring-loaded cap is situated in a central zone in which there are no electric heater elements. This cap is pressed down by the base of the pan so that a heat contact is brought about between the sensor and the base of the pan. The heating power is switched off via the sensor.

The temperature-controlled switching off of the boiling phase is not entirely satisfactory either, since the right moment for switching off is in no way connected with a fixed base-sensor temperature. The switching-off point depends rather on a number of other parameters, such as the volume of liquid in the pan, the heat capacity of the liquid, the heating power, the upward shift in the boiling point due to dissolved substances, and is even dependent to a slight extent on the atmospheric pressure barometer reading in the kitchen. The user requires some experience in order to find the approximately correct setting for the given pan, filling volume and liquid to be boiled. The presetting is in general so unreliable that no user of appliances at present available on the market could leave milk, for example, to heat up to the boiling point unattended. Either the heating power is turned down too late, in which case the pan has to be removed from the electric hotplate to avoid milk in particular boiling over, or the power is switched off too early, in which case delays are caused by the need for reheating. In either case, the user has to be in attendance.

It is known from EP-OS No. 0 074 108 that a temperature sensor can be used to monitor the pan-base temperature on a gas cooker and to switch off the gas supply when the temperature of the pan base no longer rises at the beginning of boiling. This measure suffices in the case of gas cooking, since the heat supply can be abruptly cut off. In the case of electric cooking, heat continues to be supplied even though the power has been switched off. Switching off at the moment the boiling point is reached does not therefore suffice.

SUMMARY OF THE INVENTION

The object of the invention is to enable the electrical heating of food material of at least partially liquid substance which is to be boiled to switch itself off without boiling over.

The method of the cooker according to the present invention is characterized in that at the beginning of the heating process the power supplied to an electric hotplate can be set to a constant value which can be selected;

a microprocessor continuously monitors in equal time intervals the temperature of the base of the pan and determines the rise in the temperature of the pan base as a function of time; so that at a pan-base temperature above about 70° C. the actual value of the rise in the temperature of the pan base can be compared with a desired value, and when deviations occur the heating power is switched over to generate the approximate actual value of the rise in temperature to the desired value; and at a pan-base temperature above about 90° C. a bending point in the temperature rise of the pan base can be determined, whereupon the heating power is switched off.

The pan-base temperature, after a brief initial delay, shows a largely linear, constant increase with time. The magnitude of the increase is mainly determined by the volume of the liquid to be boiled, by its heat capacity and by the magnitude of the electric power supplied. Before the boiling point is reached, a bending point occurs in the temperature rise of the pan base. The time that elapses between this point and the moment the boiling point is reached depends again upon the volume of the liquid to be boiled, its heat capacity and the magnitude of the electric power supply. For this reason, above 70° C. heating temperature the heating power is controlled in such a way that the rise in the temperature of the pan base approximates to a desired value. The temperature value is so selected that, when the power is switched off at the moment the bending point in the temperature rise is reached, the value of the energy supplied to the hotplate is approximately equal to or somewhat larger than the energy to be supplied to the liquid being boiled before it reaches its boiling point. In this way the hotplate power supply can be switched off at the moment the bending point in the temperature rise curve is reached, so that the liquid to be boiled is no longer fed with the heating energy that is responsible for boiling over.

In a further embodiment of the invention a provision is made for switching to a lower heating power at a pan-base temperature above about 70° C. and an actual value of the temperature rise that lies above a preset level.

In general, the adjustment of the heating power should preferably only be made downwards, that is to say, only when the actual value of the rise in the temperature of the pan base is too high should the heating power be reduced to a smaller value. This applies in particular when the nature of the liquid to be boiled makes it necessary to avoid unduly rapid heating up by an excessively high heating power.

Another embodiment of the invention is characterized in that:

at the beginning of the heating process the power supplied to an electric hotplate can be set to a constant value which can be selected;

a microprocessor continuously determines the rise in the temperature of the base of the pan as a function of time, so that at a pan-base temperature above about 70° C. the actual value of the rise in the temperature of the pan base is compared with a desired value, and when deviations occur the heating power is switched over so as to generate an approximate actual value of the rise in temperature which equals the desired value, and at a pan-base temperature above about 90° C. and at an actual temperature rise value that cannot sufficiently be corrected upwards to the desired value, a time delay is applied in switching off the heating power after a bending point in the temperature rise of the pan base is reached.

When, at a pan-base temperature above 70° C., the actual value of the temperature rise lies below the desired value and the actual value cannot be made equal to the desired value by increasing the heating power, or when an increase in the heating power is not provided for or is undesirable, then upon switching off the heating power when the bending point in the rise in the temperature of the pan base is reached the liquid in the pan would not come to the boil since the energy stored in the pan would not be sufficient to bring the liquid to the boil. For this reason the heating power is not switched off at the moment the bending point in the temperature rise is reached but only after a time delay. The value of this delay depends again upon the volume of the liquid for boiling, its heat capacity and the magnitude of the electric power supplied, and hence upon the actual value of the rise in temperature above 70° C. This method ensures that, irrespective of the preset heating power and of the volume and heat capacity of the liquid for boiling, the pan is supplied with exactly as much electrical energy as is required for the liquid to reach its boiling point.

A further embodiment of the invention is characterized in that the microprocessor determines from the actual value of the rise in temperature of the pan base below about 70° C. and from the heating power the heat capacity of the pan with food material and from this the desired value of the temperature increase.

When the electric power supplied and the parameters of the cooker appliance are known, it is possible to deduce the heat capacity of the liquid to be boiled from the curve showing the actual value of the increase in the temperature of the pan base. When the heat capacity of the liquid to be boiled is known, it is in turn possible to determine the desired value of the rise in the temperature of the pan base at which the liquid to be boiled subsequently reaches its boiling point after the heating power has been switched off upon the bending in the heating curve point being reached.

In a further embodiment of the invention it is provided that the determination of the pan-base temperature takes place in equal intervals of less than 30 seconds, preferably 5 to 15 seconds. If the cooking appliance has a sufficiently fast response time, the determination of the pan-base temperature should be made in intervals of less than 30 seconds to ensure that the actual rise in the pan-base temperature is established at exactly the right time, so that the heating power can be switched off early enough. A determination in intervals of about 5 to 15 seconds has proved advantageous.

A further embodiment of the invention is characterized in that the rise in the temperature of the pan base is averaged over several values. The danger of a wrong response is additionally reduced by determining over several values the average increase of the pan-base temperature as established from the individual measurements, so that single overshoots in the determination of the pan-base temperature carry less weight and thus reduce the risk of a false response in the automatic control of the heating process.

In a further embodiment of the invention it is provided that, after the full heating power has been switched off, the hotplate switches itself to a lower power which can be set in advance. In this way, by means of presetting the power, automatic switching takes place to the continued lower power.

With the cooker in accordance with the invention the true boiling point is determined well before it is reached, irrespective of the boiling temperature, which fluctuates in dependence on the concentration of the cooking substance, the level above normal zero and the air pressure. Allowance is also made for differences in volume or heat capacities of the liquid to be boiled, so that even small volumes of liquid, or liquids of lower heat capacity, do not boil over, while on the other hand the boiling point of larger volumes, or of liquids of higher heat capacity, is safely reached. No absolute calibration of the temperature sensor is needed. All that is required is a sufficiently linear relative temperature course. Hitherto conventional cooking utensils can therefore continue to be used. Aluminium, steel or laminated pan bases as ordinarily used for electric cookers are all that is required. Food requiring careful heating, as for example milk, can be boiled unattended, irrespective of the amount.

Embodiments of the invention will now be described in more detail, by way of example with reference to the accompanying drawings.

DESCRIPTION OF THE PREFERRED EMBODIMENT

Figure 1:
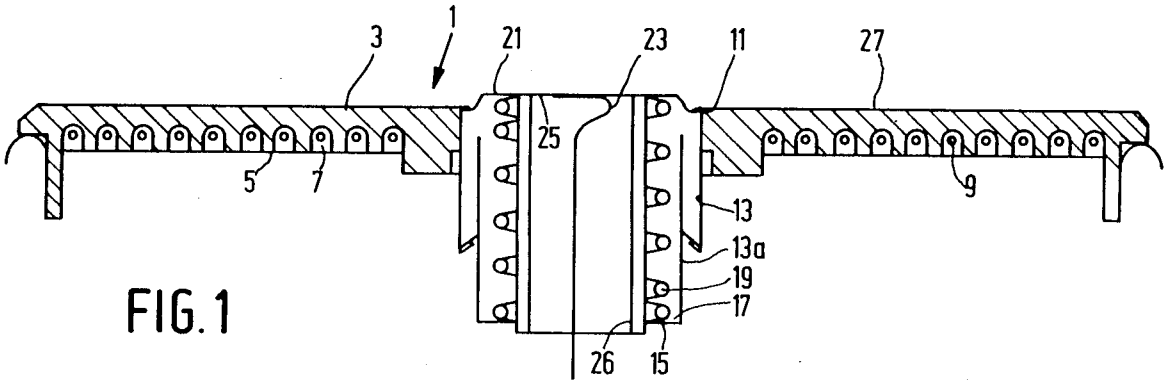
FIG. 1 shows a conventional hotplate with a temperature sensor for determining the temperature of the base of a pan for use on electric cookers.

The hotplate 1 shown in cross-section in FIG. 1 consists of a flat cast-iron body 3 the underside 5 of which is provided with helical grooves 7. Fitted in these helical grooves 7 are heater spirals 9.

In a central zone 11, in which there are no heater spirals 9, a guide sleeve **13*a* is contained in a support sleeve 13 which is fixed to the hotplate 1 and which is provided at the underside 15 with ledge 17 indented inwards. Supported on this ledge 17 is a helical spring 19 which presses against a contact cap 21, pushing it upwards against the base of a cooking vessel (pan) placed upon it. Inside the spring 19 is a temperature sensor 23 which is in contact with the underside 25 of the cap 21. The temperature sensor 23 is to a large extent shielded against heat radiation from the hotplate by a double-walled radiation screen 26. A pan placed on the hotplate 1 presses with its base against the cap 21, pushing it down into the plane of the flanged upper side 27 of the hotplate. In this way good thermal contact is established between the base of the pan and the temperature sensor 23**.

Figure 2:
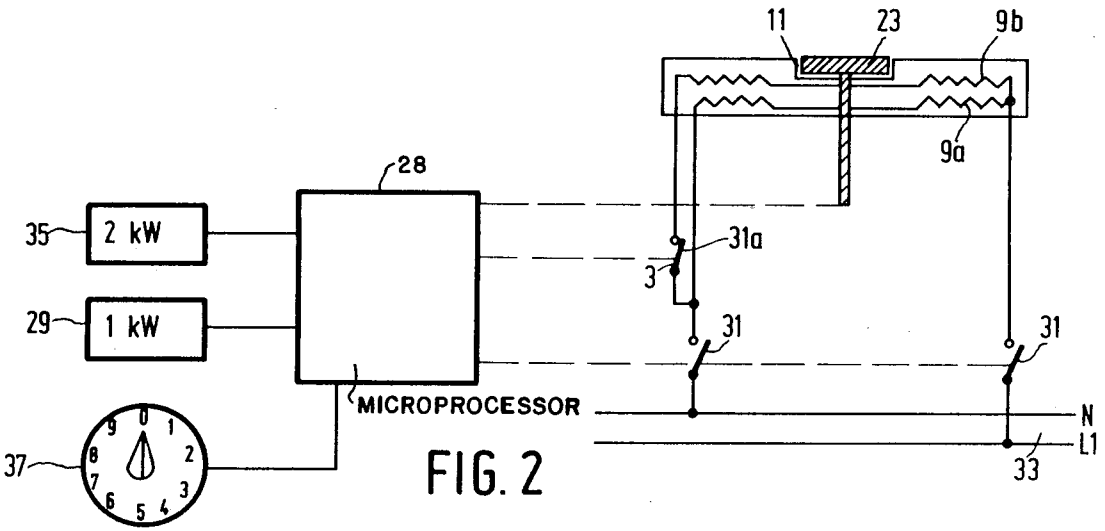
FIG. 2 shows a diagram of a circuit arrangement for operating an electric hotplate using a microprocessor of the invention.

The basic diagram in FIG. 2 illustrates the way in which the hotplate heating is controlled. The temperature sensor 23 situated in the spiral-free central zone 11 is connected to a microprocessor 28. The hotplate 1 contains two separately switchable heater spirals 9*a* and 9*b*. By means of a two-pole switch 31 and a single-pole switch 31*a* the microprocessor 28 can connect the heater spirals 9*a* and 9*b* to the mains supply 33. By means of the preselector buttons 29 and 35 and an energy controller 37, with which interval control of the heater spirals 9*a* and 9*b* is possible, the micro-processor 28 can be preprogramed with the desired full-heat and reduced-heat power values, so that the microprocessor can automatically switch from full heating to reduced (continued) heating.

Figure 3:
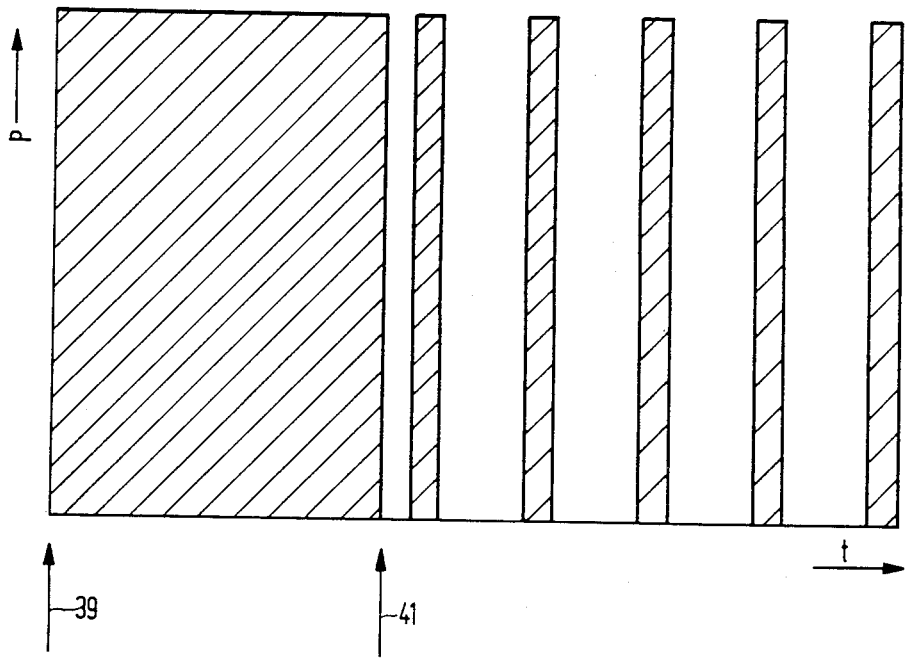
FIG. 3 shows a time-power diagram for full power heating and continued heating at lower power.

FIG. 3 shows a time and power diagram for the full heating and reduced heating processes. The diagram illustrates that by pressing one of the buttons 29 or 35 the full-heating power can be preselected. The pressing of one of the buttons 29 or 35 is indicated by the case 39 in FIG. 3. In this example the full-heating power does not change. Arrow 41 indicates the moment of time at which the full-heating process is terminated. If continued (reduced) heating is required, the setting of the energy controller 37 determines the electric power to be supplied during the continued heating. The hatched areas in FIG. 3 indicate the intervals of time in which heating power is supplied to the hotplate.

Figure 4:
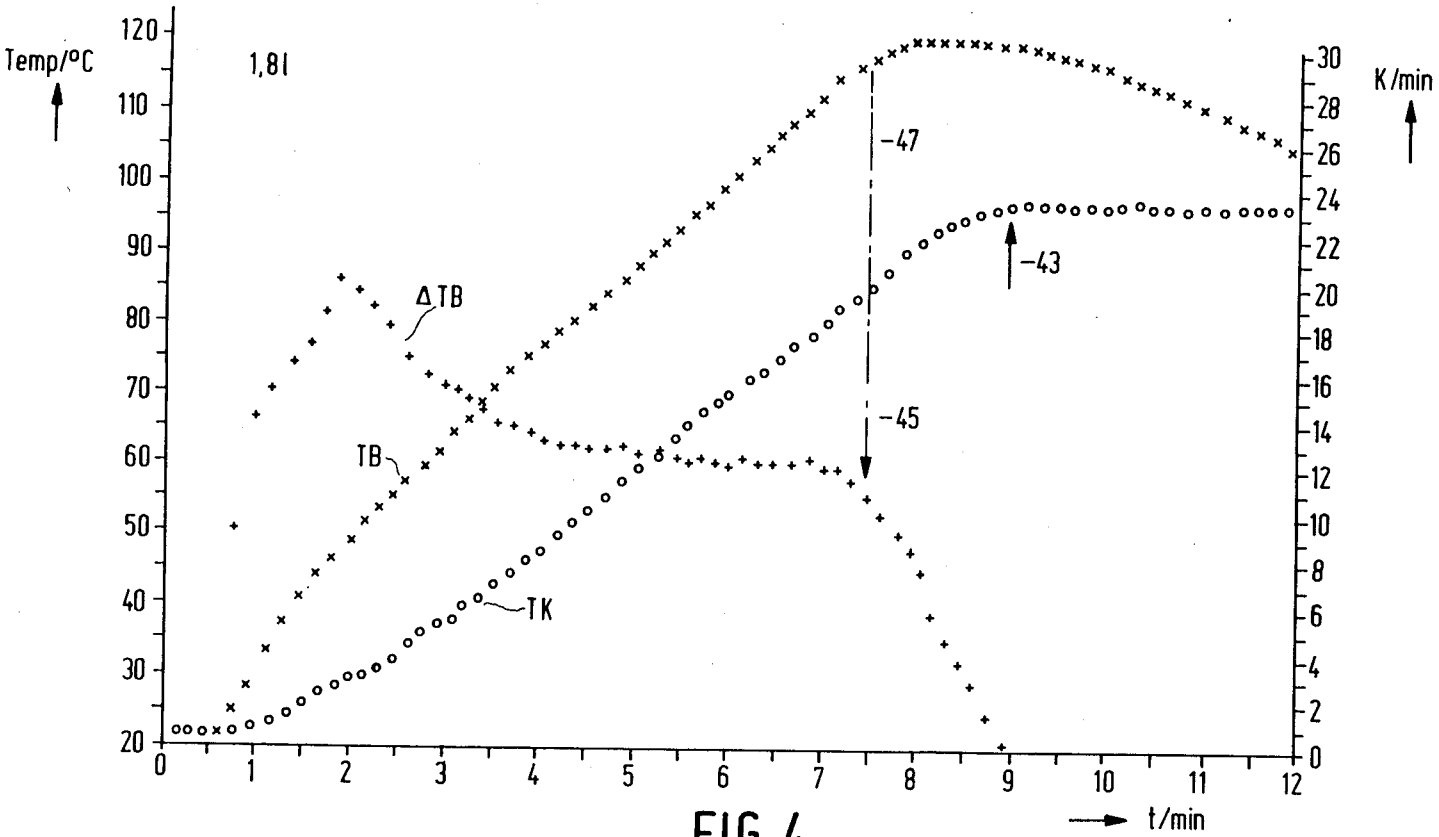
FIG. 4 shows a plot of the pan-base temperature versus time, showing the rise in temperature that takes place when boiling a liquid on an electric cooker, in which the heating power is neither changed nor switched off after a delay.

FIG. 4 shows curves of the pan-base temperature as a function of time in a full-heating process. In this example the volume of the liquid to be boiled and its heat capacity are so chosen that the full-heating power neither changes nor is switched off with a time delay. It is assumed with these pan-base temperature curves that the liquid to be boiled is not touched during the heating process and that no further liquid is added.

The temperature of the liquid to be boiled TK rises after a certain time delay up to the boiling point indicated by the arrow 43. By means of the temperature sensor 23 the temperature of the base of the pan TB is measured. After a short initial delay the pan-base temperature shows a largely linear, constant increase with time. The magnitude of the increase is mainly determined by the volume and specific coefficient of the liquid to be boiled and the magnitude of the electric power supplied. The heat capacity can be determined as follows:

$$\text{Heat capacity } C = \frac{\text{Heating power } Pa}{\text{Temperature difference } \Delta T/\text{Time pitch } \Delta t}$$

From the so-determined heat capacity C the desired value can be calculated. The microprocessor 28 measures the pan-base temperature in intervals of about 5 to 15 seconds and stores these values. From one measured value to another the microprocessor compares the actual value of the pan-base temperature with the previous one and determines from this the value of the increase ΔTB. This results in a curve ΔTB as also shown in FIG. 4. In this way the microprocessor determines in the temperature range above about 70° C. pan-base temperature the actual value of the increase in the temperature of the pan base. From this value the amount of heat of the liquid is determined and from this the desired value of the increase is established. The actual value of the increase is now compared with the determined desired value of the increase. In the example illustrated in FIG. 4 the actual value of the increase is about 12 Kelvin per minute. It is assumed that this value corresponds approximately to the desired value of the increase. For this reason the full-heating power in the example in FIG. 4 is not changed. Above about 90° C. pan-base temperature the rise of this temperature shows a very marked bending point. This point is indicated by the arrow 45 and its extension 47. In the example shown, this bending point occurs about 1½ minutes before the boiling point at arrow 43 is reached. At the moment this bending point in the rise in the temperature of the pan base is reached (line 47, arrow 45) the heating power is switched off. The remaining time until the boiling point is reached is sufficient to prevent even milk from boiling over.

Figure 5:
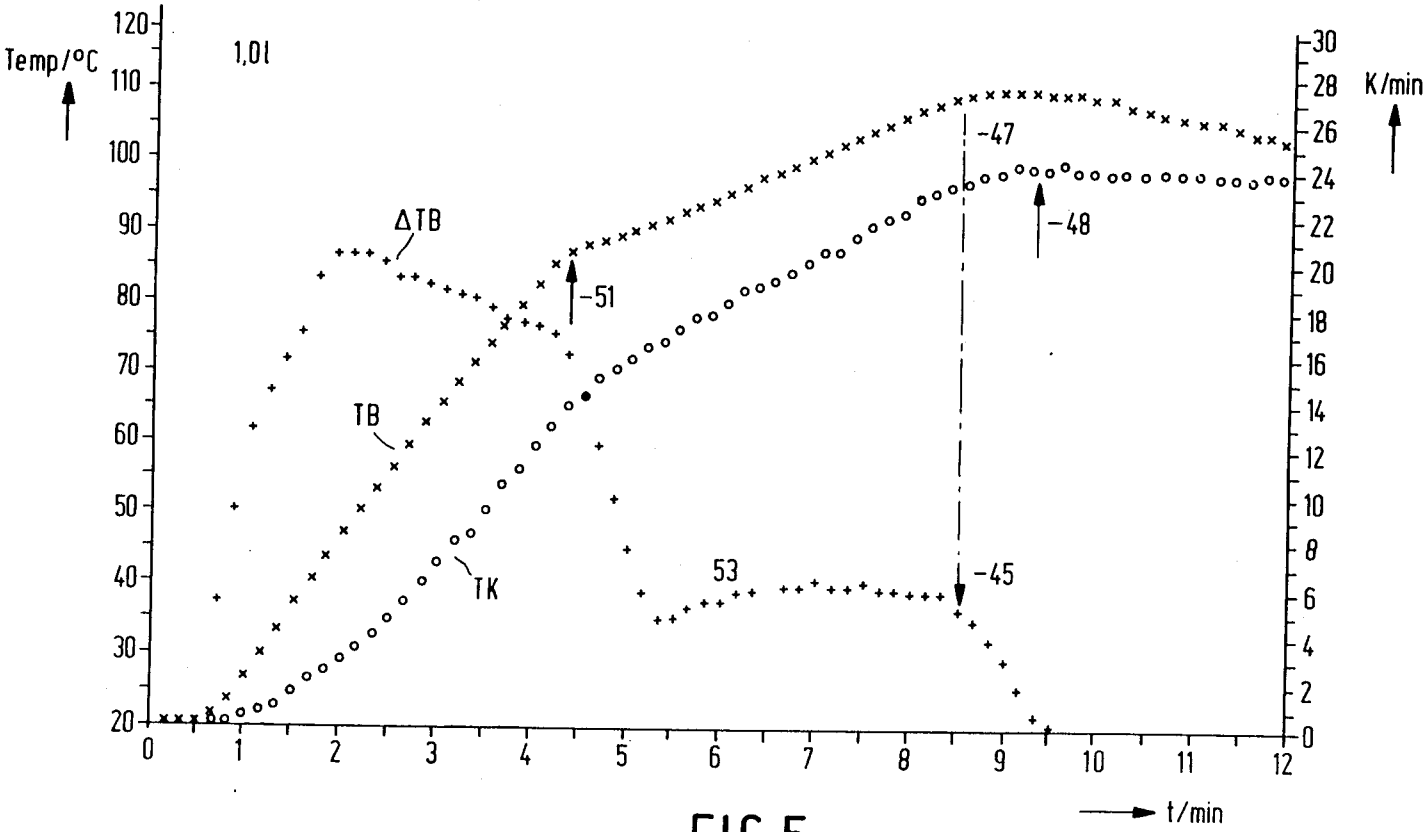
FIG. 5 shows a plot of the pan-base temperatures versus time, with the rise in temperature that takes place when boiling a liquid on the same electric cooker which switches over to a lower heating power.

FIG. 5 shows the time curves for the same cooking appliance for a heating process in which only one liter of water is to be boiled. After the initial rise in the temperature curves of the heating process, the microprocessor again determines above 70° C. pan-base temperature the actual value of the temperature increase, which in the example shown in FIG. 5 amounts to about 16 to 18 Kelvin per minute. Since this actual value is higher than a preset rate of increase, which for example could again be about 12 Kelvin per minute, the heating power is reduced, as indicated in FIG. 5 by a bending point in the pan-base temperature marked by arrow 51. After this switching of the heating power the value of the rate of increase ΔTB drops to about 6 Kelvin per minute, which is shown in the figure by the curve section 53. The heating power is again switched off at the beginning of the bending point in the rise of the pan-base temperature, as indicated by the arrow 45 and its extension 47. In this example the liquid being boiled reaches its boiling point about one minute later, which is indicated in the figure by the arrow 48 marking the curve TK.

Figure 6:
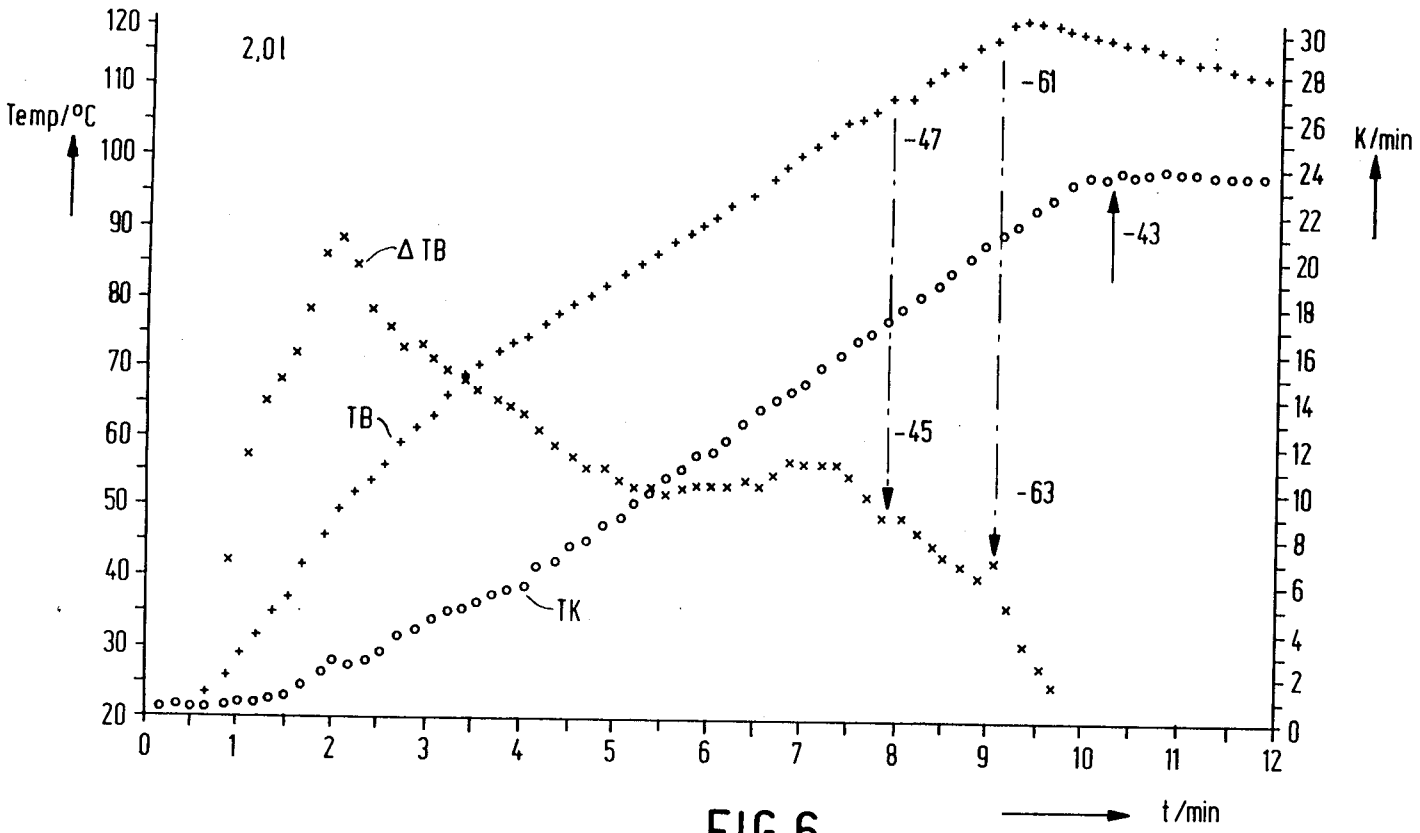
FIG. 6 shows a plot of the pan-base temperatures versus time, with the rise in temperature that takes place when boiling a liquid on the same electric cooker, where the heating power remains unchanged but is switched off with a time delay.

FIG. 6 shows the temperature curves of a heating process with again the same cooker, but this time for two liters of water. Above 70° C. pan-base temperature the increase ΔTB is in this example only about 10 Kelvin per minute. It is assumed in this example that the heating power is not increased by the microprocessor 28. Since the actual value of the rise in the pan-base temperature is below an assumed desired value of the rate of increase, which is about 12 Kelvin per minute, switching off the heating power at the bending point in the rise of the pan-base temperature, as represented in the figure by arrow 45 and its extension 47, would not leave enough energy stored in the cooker to bring the liquid to the boil. For this reason the microprocessor determines from the value of the increase (here about 10 Kelvin per minute) a delay time for switching off the full heating power. In the example shown, the delay time is about one minute.

The switching-off point thus calculated is indicated in the Figure by arrow 63 and its extension 61. After the heating power has been switched off, the liquid in this example reaches its boiling point about 1½ minutes later, which is indicated in the figure by arrow 43.

FIGS. 4, 5 and 6 thus show three heating processes with the same cooker, which is arranged in such a way that in the first case the actual value of the increase corresponds to the desired value, in the second case the actual value of the increase lies above the desired value, and in the third case the actual value of the increase lies below the desired value. In the example given in FIG. 6 it is assumed in addition that when the actual value of the rate of increase is below a prescribed desired value the heating power is not raised. For this reason, after the bending point in the rise of the pan-base temperature the heating power is not switched off until after a certain delay. It would also be possible, however, given an established actual value in the rate of increase below a preset desired value, to increase the heating power. When in such a case, after increasing the heating power, the actual value of the rise in the pan-base temperature reaches the preset desired value, the heat can be switched off as soon as the bending point in the rise in the pan-base temperature is reached and not after a programmed delay.

What is claimed is:

1. A method for automatically controlling heating of a pan with food material in order to avoid boiling over at an end of a heating process, whereby during the heating process rise in temperature of a base of the pan is continuously determined as a function of time by means of a temperature sensor, comprising:

setting at a beginning of the heating process power supplied to an electric hotplate to a constant value;

continuously monitoring with a microprocessor in equal time intervals the temperature of the base of the pan and determining rise in the temperature of the pan base as a function of time;

comparing the actual value of the rise in the temperature of the pan base at a pan-base temperature above about 70° C. with a desired value, and when deviations occur, changing the heating power to achieve an actual value of the rise in temperature equal to the desired value; and switching the heating power off at a pan-base temperature above 90° C. when a bending point in the temperature rise of the pan base is determined.

2. A cooking method as claimed in claim 1, wherein said heating power is changed to a lower heating power at a pan-base temperature above about 70° C. and an actual value of temperature rise that lies above a preset level.

3. A cooking method of claim 1, wherein the microprocessor determines from the actual value of the rise in temperature of the pan base below 70° C., and the heating power, the heat capacity of the pan with food material and the desired value of the temperature increases.

4. A cooking method as claimed in claim 1, wherein the determination of the pan-base temperature takes place in equal intervals of less than 30 seconds.

5. The cooking method of claim 4 wherein the determination of pan-base temperature occurs in equal intervals of 5 to 15 seconds.

6. A cooking method as claimed in claim 1, wherein the rise in the temperature of the pan base is averaged over several values.

7. A method for automatically controlling heating of a pan with food material in order to avoid boiling over at an end of a heating process, whereby during the heating process rise in temperature of a base of the pan is continuously determined as a function of time by means of a temperature sensor, comprising:

at a beginning of the heating process, setting the power supplied to an electric hotplate to a constant value;

continuously determining the rise in temperature of the base of the pan as a function of time with a microprocessor;

at a pan-base temperature above 70° C., comparing an actual value of the rise in the temperature of the pan base with a desired value, and changing the heating power which will change the actual value of the rise in temperature to the desired value; and when said actual temperature rise value cannot sufficiently be corrected upwards to the desired value, switching off the heating power a fixed time delay subsequent to a bending point in the temperature rise of the pan base.

8. A cooking method as claimed in claim 7, wherein after the heating power has been switched off, the hotplate is switched to a lower power which can be set in advance.

* * * * *